United States Patent [19]

Peters

[11] 4,244,473

[45] Jan. 13, 1981

[54] COMPOSITE PACKING

[75] Inventor: Carl H. Peters, Falsterbo, Sweden

[73] Assignee: Platmanufaktur AB, Malmo, Sweden

[21] Appl. No.: 12,944

[22] Filed: Feb. 15, 1979

Related U.S. Application Data

[63] Continuation of Ser. No. 848,885, Nov. 7, 1977, abandoned.

[30] Foreign Application Priority Data

Nov. 17, 1976 [SE] Sweden ..... 7612865

[51] Int. Cl.[3] ..... B65D 65/34; B65D 77/36

[52] U.S. Cl. ..... 206/605; 206/616; 206/631; 206/633; 220/279; 220/463

[58] Field of Search ..... 206/605, 604, 613, 616, 206/631, 633, 634, 628, 626, 602, 603; 229/7 R, 17 R, 14 BE, 14 BL, 14 B; 220/256, 258, 462, 463, 279

[56] References Cited

U.S. PATENT DOCUMENTS

| | | | |
|---|---|---|---|
| 2,082,760 | 6/1937 | Berni | 206/634 |
| 2,146,226 | 2/1939 | Punte | 229/7 R |
| 2,352,766 | 7/1944 | Bogue | 206/634 |
| 2,365,159 | 12/1944 | Walton et al. | 229/17 R |
| 2,375,632 | 5/1945 | Cosmo | 206/634 |
| 2,398,405 | 4/1946 | Brooks | 206/634 |
| 2,583,211 | 1/1952 | Fleming | 229/7 R |
| 2,760,714 | 8/1956 | Rasmussen | 229/7 R |
| 3,024,958 | 3/1962 | Loderhose | 229/17 R |
| 3,054,680 | 9/1962 | Mennen | 206/628 |
| 3,069,043 | 12/1962 | Bishop | 206/628 |
| 3,899,079 | 8/1975 | Seiter | 206/634 |
| 3,944,127 | 3/1976 | Bruke et al. | 229/7 R |

FOREIGN PATENT DOCUMENTS

| | | | |
|---|---|---|---|
| 2805432 | 12/1978 | Fed. Rep. of Germany | 206/628 |

*Primary Examiner*—Herbert F. Ross

*Attorney, Agent, or Firm*—Hane, Roberts, Spiecens & Cohen

[57] ABSTRACT

A packing comprising an outer cover constituted by a relatively rigid material and an inner container of relatively flexible material placed within the outer cover. A perimetral rim portion is formed on the outer cover at one end with a central opening within the rim. A disc is disposed within the rim to define a narrow gap therewith extending around the periphery of the disc. The disc is constituted of the same material as the outer cover and is affixed at its inner surface to the outer surface of the inner container by glue or other suitable expedient. The cover can be removed by cutting the inner container at the gap to expose the contents in the inner container or a tear-off tape can be provided on the inner container at the gap so that when the tear-off tape is removed the cover and the portion of the inner container affixed thereto are removable.

9 Claims, 6 Drawing Figures

COMPOSITE PACKING

This is a continuation application of application Ser. No. 848,885 filed Nov. 7, 1977 now abandoned.

FIELD OF THE INVENTION

The present invention relates to a packing of the type with an outside supporting cover and with a container made of a flexible material, placed in this outside cover, which container is intended to receive powdered, fluid, semi solid, and solid substances.

PRIOR ART

As a packing for substances of the above-mentioned type, it is known, for instance to use a combination of a stiff outside cover and an inside container made of foil. Several solutions are known for the fastening of the inside container to the outside container. One of these solutions contemplates that the inside container is fastened to the outside container primarily at the opening part of the container in such a way that the inside container and the outside cover are firmly connected with each other. In this way it is possible for an opened container to be shut again by placing a cover against or around the opening part of the outside cover. In the known solutions of this type the opening part is fitted with an upwards directed frame, so that the surface of the inside container is lowered in the opening part in proportion to the upper part of the frame. It also applies to already known packings of this type that they are equipped with a cover, which can be taken off or which is connected with the outside cover, but where the inside container of the unopened packing makes up the limiting surface in the opening part when the cover has been lifted up or folded up.

Packings intended for storage of the above-mentioned substances are often used in sizes holding about 1 kg or less. With a view to transportation, it is desirable that the packings of current interest here can be stacked on each other without being deformed. The packing described in the previous paragraph can be used in that way only if the packing is equipped with a stable lid, e.g. made of plastic, which will absorb the forces which arise when a large number of packings are placed on top of each other. From a financial point of view the demand for a lid will give rise to additional costs, which in many cases will not be accepted by a buyer. The frame-like construction will also entail a certain complication of the packing, which will result in a certain increase in costs.

SUMMARY OF THE INVENTION

The present invention applies to a packing which is composed of a flexible inside packing and an outside supporting cover, where the inside packing is fastened to the supporting cover primarily in its opening part, but where the drawbacks mentioned in the previous paragraph have been eliminated. According to the invention, the inside container is mainly arranged in the opening part level with the frame-like limiting surface of the supporting cover. The opening of the packing comprises almost a whole lateral face of the outside cover. In the opening part the inside container is equipped with a protective outside disc, which is firmly fixed to the inside container. The protective disc is completely separated from the outside cover, i.e. from the supporting cover. This will form a narrow gap between protective disc and the outside cover. In this gap, the inside container makes up the outside limiting surface of the packing.

The packing is opened by cutting, by means of a sharp object, e.g. a knife, the protective disc and the part of the inside container which is connected with the disc from the outside cover. The cutting in question can be performed so that the protective disc with the connected part of the inside container is completely separated from the outside cover or is only separated to such an extent that the disc together with the fixed part of the inside container can be folded up. In the latter case, the packing can, to some extent, be closed again when the disc together with the connected part of the inside container is folded down into the opening part again.

In one variant of the invention, the tape-like area between a protective disc and the outside cover, i.e. the area where the inside container makes up the outside limiting surface of the container, is equipped with a tear-off tape. The tear-off tape can be fastened to the inside container and/or the protective disc in such a way that the protective disc will be fully or partly released from the outside cover when the container is torn open.

The tear-off tape can be fixed at its end against the inside container where this is connected with the protective disc, which makes it possible to remove the protective disc from the packing by means of the tear-off tape when the tearing-off operation has been finished. As an alternative or in combination with this operation, the protective disc can be equipped with a separate grip device.

The packing is even adapted to be equipped with a tightly-fitting lid, which can, for instance, be placed around the outside cover in its opening part.

BRIEF DESCRIPTION OF THE DRAWINGS

The invention is described in detail in connection with the drawings, wherein.

DETAILED DESCRIPTION

Figure 1:
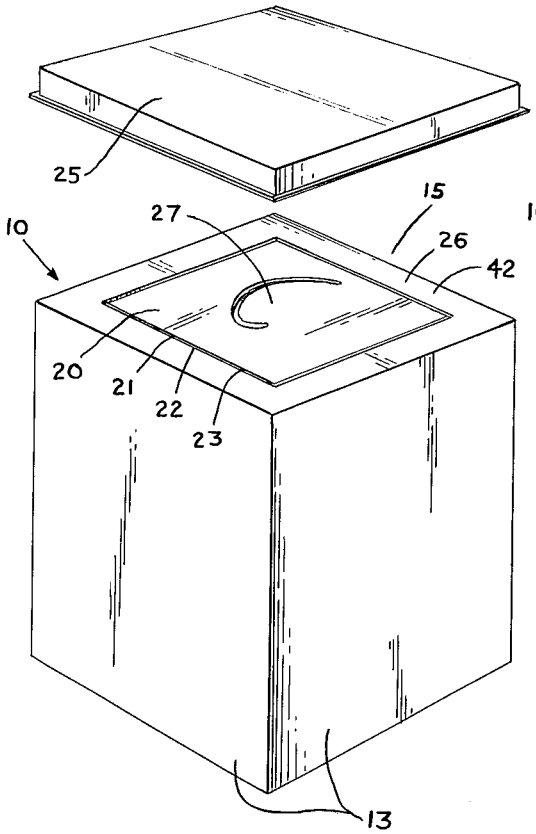
FIG. 1 shows a filled packing with lid.
Figure 3:
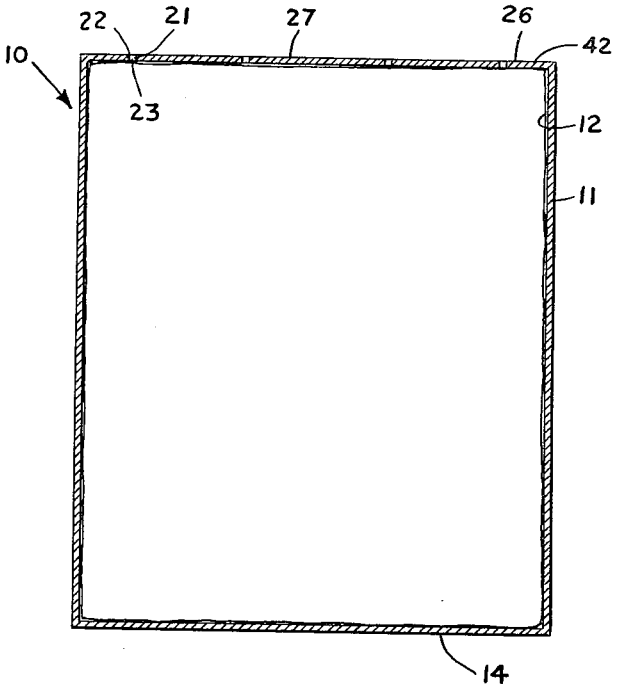
FIG. 3 shows a cut-away view of a packing.
Figure 2:
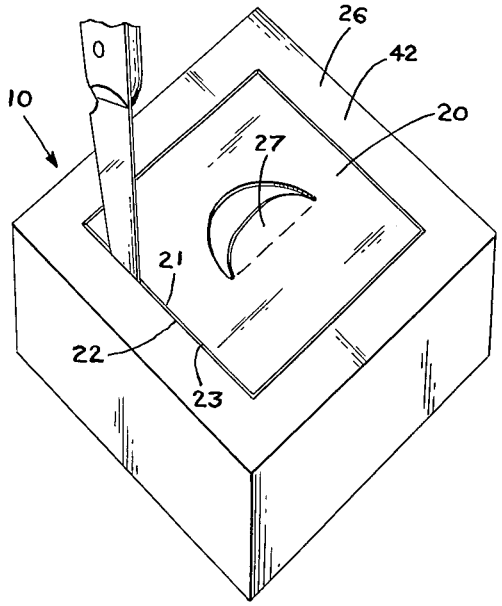
FIG. 2 shows a filled packing being opened by means of a knife.

In FIGS. 1 to 3 is shown a packing 10 consisting of an outside cover 11 and an inside container 12. The outside cover is made of a relatively stable material, for instance cardboard, whereas the inside container consists of a flexible material, for instance plastic. The outside cover limits the packing by means of a number of lateral faces 13, and by means of a bottom surface 14 and an opening part 15. The outside cover has in the opening part a perimetral rim or frame 42. This forms in the opening part a frame-like limiting surface 26, which is primarily parallel with the bottom surface 14 of the outside cover. The inside container 12 is fastened to the frame. The inside container has a substantially plane surface against the opening part of the outside cover, which thus stretches over the whole of the opening part of the outside cover. The inside container is protected in the opening part by a disc 20. The disc 20 is fixed to the inside container. The outside limiting surface of the disc or plate 20 is substantially level with the frame-like limiting rectangular surface 26 of the supporting cover. The edge of the frame 21 and the edge of the disc 22 are primarily parallel with each other, which forms a narrow gap 23 between the two edges, in which gap the inside container makes up the outside limiting surface of the packing. The disc 20 can be equipped with a grip device 27. This can be made as a cut-out flap of the disc, which is lifted when it is used. A lid 25 is arranged to tightly fit around the opening part of the outside cover.

Figure 4:
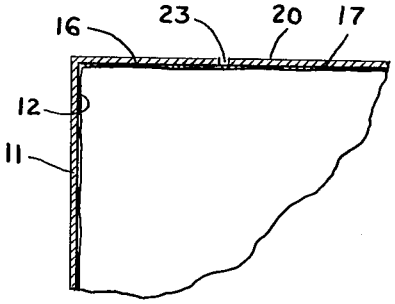
FIG. 4 shows in detail a cut-away view of a section of the opening part.

In FIG. 4 is shown in detail how the inside container 12 is connected with the frame 42 of the outside cover. It appears from the figure that the inside container can be connected with the frame by means of a layer of glue or a welded joint 16. The fastening in question is mainly made so that the inside container, at least up to the edge 21 of the frame, is mainly in contact with the bottom of the frame and outwards along the whole area of the edge. It also appears from the figure that the inside container is connected with the disc 20, for instance, by means of a layer of glue or welded joint(s) 17.

Figure 5:
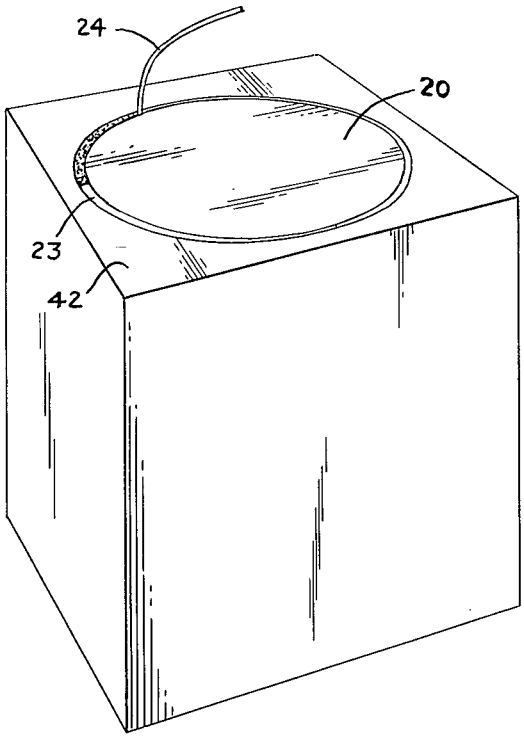
FIGS. 5 and 6 respectively show in closed and open conditions, a packing with tear-off tape and where the opening part of the packing is equipped with a circular protective disc.
Figure 6:
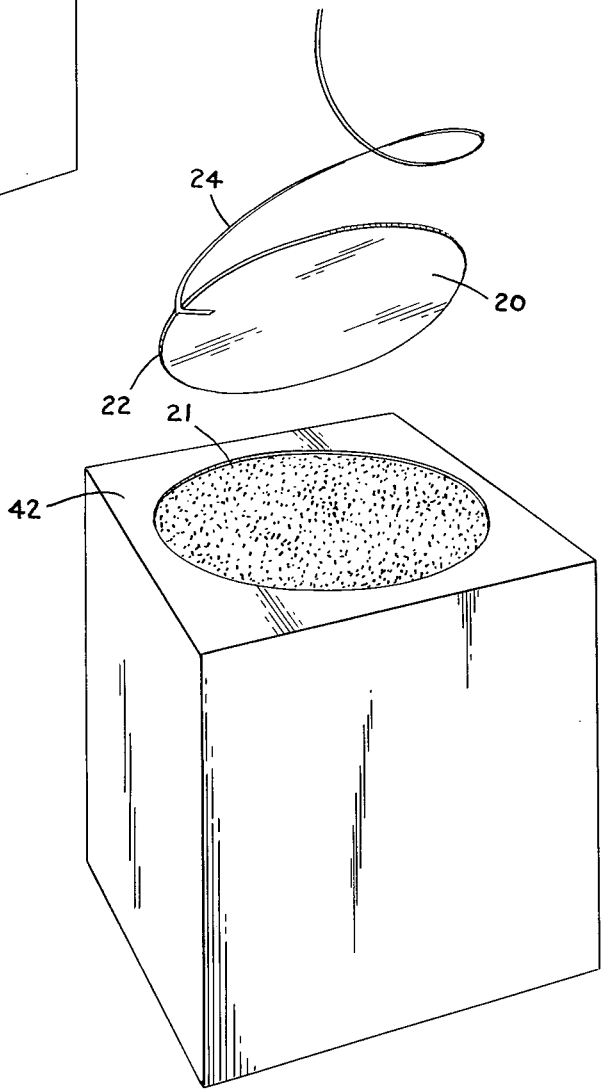

FIGS. 5 and 6 show how a tear-off tape 24 has been connected to the inner container along the entire length of the gap 23 of the packing. The tear-off tape can be arranged so that it will sever only the inner container along said gap and have its inner end fixed to the disc 20 when the packing has been opened as seen in FIG. 6. The advantage of this is that the opening of the packing is automatically completed when the disc is lifted from its position in the opening part of the packing. FIG. 5 shows a packing being opened, whereas FIG. 6 shows a packing when the opening operation has been finished.

FIGS. 5 and 6 show the packing in which the disc 20 has a circular appearance, whereas in FIGS. 1–3 the packing is square. The disc 20 can have other geometrical shapes within the concept of the invention. It can, e.g., be rectangular or curved other than circular.

The edge 21 of the frame just like the edge 22 of the disc are mainly made as plane edges which extend parallel with each other. The distance between the edges has been chosen to fit normally used cutting devices, for instance a knife. The distance is usually between 0.25 mm and 8 mm, and the selected distance is primarily 1 mm. A suitable material for the inside container is, for instance, a multi-layer plastic film. When the packing is used for storage, for instance, of coffee, it is a requirement of the plastic film that the access of acid or water vapor from atmosphere is prevented, and that aromatic compounds in the enclosed article are kept in the packing. The concept of the invention itself is obviously not dependent upon such requirements, but the qualities of the used film material and plastic material respectively will no doubt have to be adapted to the demands made by the articles stored in the packing.

For the outside supporting cover, it is required that the material used have sufficient stability for a packing constructed according to the invention to maintain its shape during the filling of the packing and during transportation respectively.

The outside cover is primarily made of cardboard, plastic, metal or similar materials, whereas the inside container is for instance made of plastic, paper, metal or similar materials, which have been processed so that they have the flexibility required for the packing.

A packing according to the invention is mainly filled through the part of the inside container which in the filled packing is usually found in the bottom part of the packing. When the inside container has been filled, it is sealed in known manner, for instance by means of welding and folding of a flap, and then the outside cover is closed for instance by folding it over the inside container. The packing can be arranged so that it is filled after the inside container has been fastened to the outside cover, but within the concept of the invention it is even possible first to fill the inside container and then to fasten this to the outside cover.

What is claimed is:

1. A packing comprising an outer cover constituted by a relatively rigid material and a filled inner container of relatively flexible material disposed within the outer cover and conforming in shape thereto, said outer cover having opposite ends and including a perimetral rim portion with a central opening at one of said ends, means connecting the inner container to the outer cover only at said rim portion, a plate disposed within the opening in said rim portion to define a narrow gap therewith extending completely around the periphery of said plate and being continuous, said plate being constituted of the same material as said outer cover, said plate having an inner surface facing the outer surface of the inner container, means securing said inner surface of the plate to the outer surface of the inner container such that said plate is secured in said packing only to said inner container and the connection of the plate to the outer container is effected solely through the intermediary of the connection of the inner container to the outer cover by said connecting means, and severing means affixed to said inner container along the entire length of said gap for severing said inner container only at said gap when said severing means is pulled, whereby upon severance of said inner container at said gap, said plate is freely removable together with the portion of the inner container secured thereto and severed at said gap.

2. A packing as claimed in claim 1 wherein said plate and rim have opposed edges which are planar.

3. A packing as claimed in claim 1 wherein said gap is of uniform width along its length.

4. A packing as claimed in claim 3 wherein said gap is between 0.25 mm and 8 mm.

5. A packing as claimed in claim 1 wherein said severing means comprises a tear-off tape on said inner container at said gap to sever said inner container at said gap.

6. A packing as claimed in claim 5 wherein said tear-off tape has one end affixed to said plate to be separable therewith as a unit.

7. A packing as claimed in claim 1 wherein said plate and rim have outer surfaces which are disposed in a common plane.

8. A packing as claimed in claim 1 wherein the plate has a round periphery.

9. A packing as claimed in claim 1 comprising a lid for tightly engaging the walls of the outer cover and covering said rim, and said plate.

* * * * *